US005340095A

United States Patent [19]

Eicher, III

[11] Patent Number: 5,340,095

[45] Date of Patent: Aug. 23, 1994

[54] ADJUSTABLE DOOR BUCK SPREADER

[76] Inventor: Charles W. Eicher, III, P.O. Box 160, South Point, Ohio 45680-0160

[21] Appl. No.: 81,098

[22] Filed: Jun. 25, 1993

[51] Int. Cl.[5] ..... E04F 21/04; B23Q 3/15

[52] U.S. Cl. ..... 269/43; 269/242; 269/905

[58] Field of Search ..... 33/194, 404, 286, 645, 33/667; 269/905, 42, 242

[56] References Cited

U.S. PATENT DOCUMENTS 751,050 2/1904 Bronk .
2,881,813 4/1959 Lacoste .
3,168,305 2/1965 Lee .
3,199,206 8/1965 Snapp .
3,851,868 12/1974 Lagasse .

*Primary Examiner*—Robert C. Watson
*Attorney, Agent, or Firm*—Richard C. Litman

[57] ABSTRACT

The present invention L elates to a door buck spreader having the capability to support and transport a door buck, or door frame, from its time of construction to its time of final installation. This spreader is a self-contained unit that does not require any additional support members or apparatus. The spreader is capable of setting standard size door and window bucks to bucks as large as eight feet across. The present invention is capable of precise adjustment due to the intel action between a threaded core member and two elongated tubular elements that each engage the core in one end and are rigidly attached to frame mounts at the other ends thereof. The present invention is further capable of adapting to most any door buck by means of longitudinally and laterally displaceable spacer elements and securing such door bucks to the spreader itself by means of a frame clamp assembly.

14 Claims, 5 Drawing Sheets

ADJUSTABLE DOOR BUCK SPREADER

BACKGROUND OF THE INVENTION

1. FIELD OF THE INVENTION

The present invention relates to spacers and spreaders used in the construction, installation, and transportation of door bucks. Devices and apparatus exist that allow carpenters and other individuals in construction to create, move about, and install these door bucks while on a construction site. Many of these inventions, however, are bulky and unwieldy, making them difficult to be operated by a single individual. Furthermore, those inventions preceding the present invention that are to be utilized by a single individual by simplification of design and size are unable to provide all of the stability and support of the present invention. The need exists for a door buck spreader that is adjustable to every standard, and some non-standard, door buck, capable of rigidly supporting the door buck during transportation via wheels incorporated within the spreader itself, as well as rigid and accurate support of the door buck during installation.

2. DESCRIPTION OF THE PRIOR ART

The necessity for carpenters to have equipment capable of assisting them in duties that are performed time and time again has not changed. In the art of carpentry, especially that of building construction, hundreds of doors and windows may be required to be installed within a single structure. The present invention facilitates the ease by which a carpenter may accomplish this task by creating an adjustable, portable door buck spreader.

In the past, previous individuals have attempted to create a device that could accommodate the carpenter n such duties. U.S. Pat. Nos. 751,050 and 2,881,813, issued to Charles L. Bronk and Francois Lacoste, respectively, disclose door, as well as window, frame setting machines and devices. However, not only are these devices large and cumbersome, requiring the devices to contact, and in certain instances, physically damage, the surrounding floors, walls, and ceilings, they also do not allow for the transportation of the door or window frame from a place cf construction to a desired final location.

U.S. Pat. No. 3,168,305, issued Feb. 2, 1965 to William F. Lee, discloses a door jamb setter that is capable of being fully retained within the confines of the door frame. A pair of right angle brackets and a pair of horizontally disposed adjustable arms are the essence of the invention. However, in order to utilized Lee's door jamb setter, selected brackets must be physically attached to the door frame to be set. Further, additional openings must be drilled, bored, or like-wise created within the door frame. Hence, although Lee's invention proposes to be a cost efficient and simple device to aid a carpenter in the installation of a door frame, it incurs a great deal of permanent damage to the door frame being placed in order for the device to be effective.

U.S. Pat. No. 3,199,206, issued on Aug. 10, 1965 to Rex J. Snapp, discloses a door frame profile gauge for plumbing a door frame so that a wall may be constructed thereabout. Further review of Snapp's door gauge reveals to a reader the complexity thereof, and although presenting an adjustable, horizontal spacing arm incorporated within the overall device, this horizontal arm is seen as an integral part of Snapp's invention and would not be functional without the ceiling beam engaging members that constitute the entire gauge. As would follow, since the device is incorporated into the ceiling of a room adjacent the door frame, it would not be readily accessible for movement thereof once the gauge has been attached to the ceiling and the door frame has been secured therein.

Lastly, U.S. Pat. No. 3,851,868, issued on Dec. 3, 1974 to Guy Lagasse, discloses an adjustable door buck spreader capable of being used by itself to rigidly support a door frame with magnetic feet, capable of offset positioning thereof for wider door bucks, that contact the door buck. It is noted, however, that the Lagasse patent does not possess means to fully clamp the door buck, nor wheels to move the door buck about.

None of the above inventions and patents, taken either singly or in combination, is seen o describe the instant invention as claimed.

SUMMARY OF THE INVENTION

Devices and apparatus exist that allow carpenters and other individuals in construction to create, move about, and install these door bucks while on a construction site. Many of these inventions, however, are bulky and unwieldy, making them difficult to be operated by a single individual. Furthermore, those inventions preceding the present invention that are to be utilized by a single individual by simplification of design and size are unable to provide all of the stability and support of the present invention. The need exists for a door buck spreader that is adjustable to every standard, and some non-standard, door buck, capable of rigidly supporting the door buck during transportation via wheels incorporated within the spreader itself, as well as rigid and accurate support of the door buck during installation.

Accordingly, it is a principal object of the invention to provide a door buck spreader that may be operated quickly and easily by a single individual for constructing, transporting, and installing a door buck.

It is another object of the invention to provide a door buck spreader that will accurately and rigidly support a door buck without causing damage thereto.

It is a further object of the invention to provide a door buck spreader having wheel assembly means incorporated therein to aid in the transportation of a door secured within such a door buck spreader.

Still another object of the invention is to provide additional adjustments means within the door buck spreader to allow the spreader to be used with any size door through the incorporation of extension elements.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
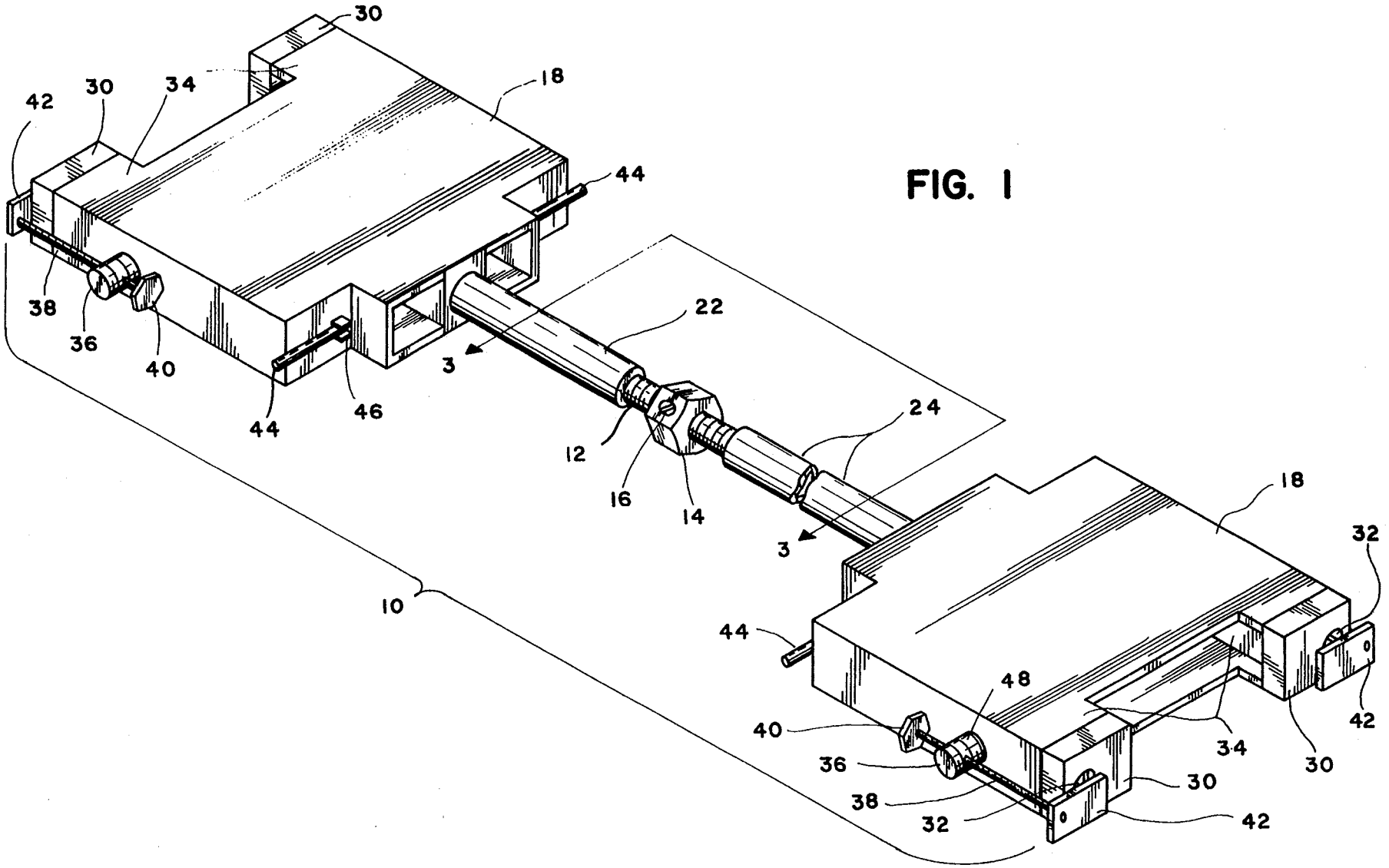
FIG. 1 is a perspective view of the door buck spreader.

Referring now to the drawings, the adjustable door buck spreader 10 is shown in its ready to use configuration in FIG. 1. Further illustrated in FIG. 1 is the threaded core member 12 having opposite threads scored thereon, originating at the ends of threaded core member 12 and terminating at their intersection at center line 15 of member 12 (see also FIG. 3). Also located adjacent center line 15 of threaded core member 12 is the hand adjustment nut 14, matingly threaded so as to be accepted along one end of threaded member 12 for adjusting the span of the spacer assembly of door buck 10 when in use. In order to secure nut 14 firmly in place along threaded core member 12, a set-screw 16 is utilized. Frame mounts 18 each have an elongated tubular elements, 22 and 24, respectively, rigidly attached thereto.

Figure 3:
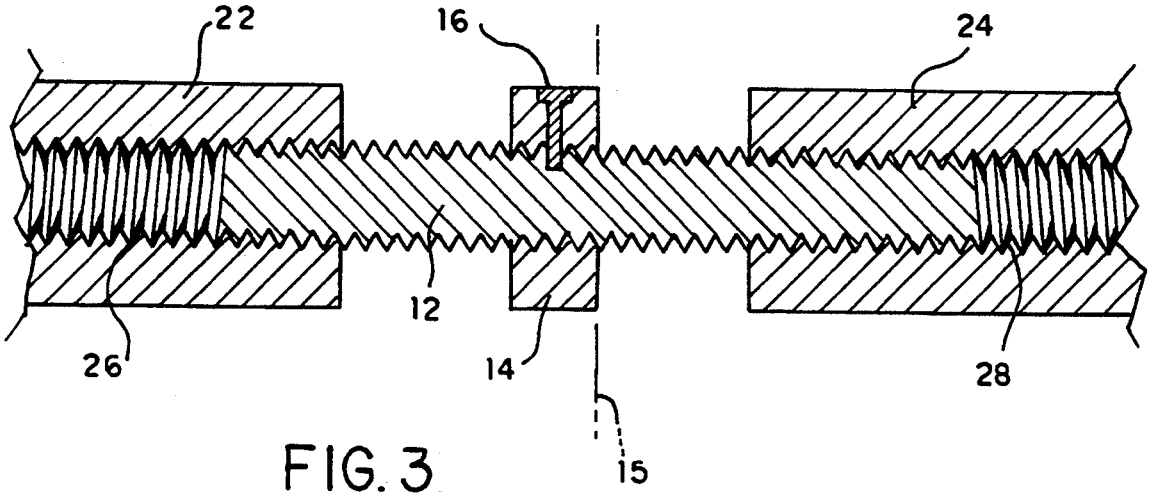
FIG. 3 is a cross-sectional view of the door buck spreader along line 3—3 of FIG. 1.
Figure 4:
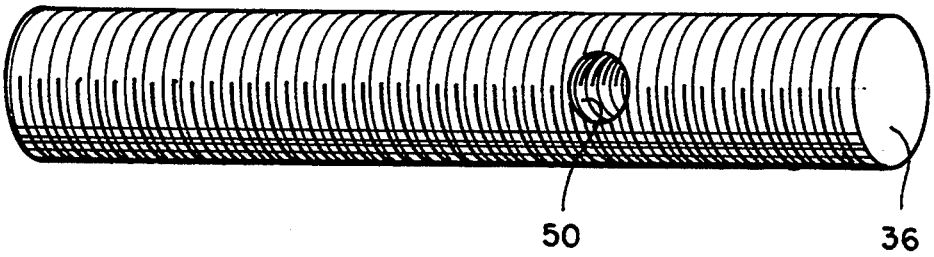
FIG. 4 is a perspective view of a single lateral adjustment member of the spreader.

Moving forward to FIG. 3, the details of the engagement of threaded core member 12 with adjustment nut 14 as well as elongated tubular elements 22 and 24 are illustrated. Each elongated element 22 and 24 engage threaded member 12 by means of threaded cores 26 and 28, respectively. Further, threaded cores 26 and 28 are threaded opposite one anointer so that when adjustment nut 14 is rotated, threaded core 12 will correspondingly be rotated, and elongated elements 22 and 24 will move together or move apart depending upon the direction of rotation in the same manner as a well-known turnbuckle arrangement. Utilization of the turnbuckle-like arrangement allows for an infinite number of adjustment points providing fine adjustment for precise dimension setting of a door buck within a structure.

Figure 2:
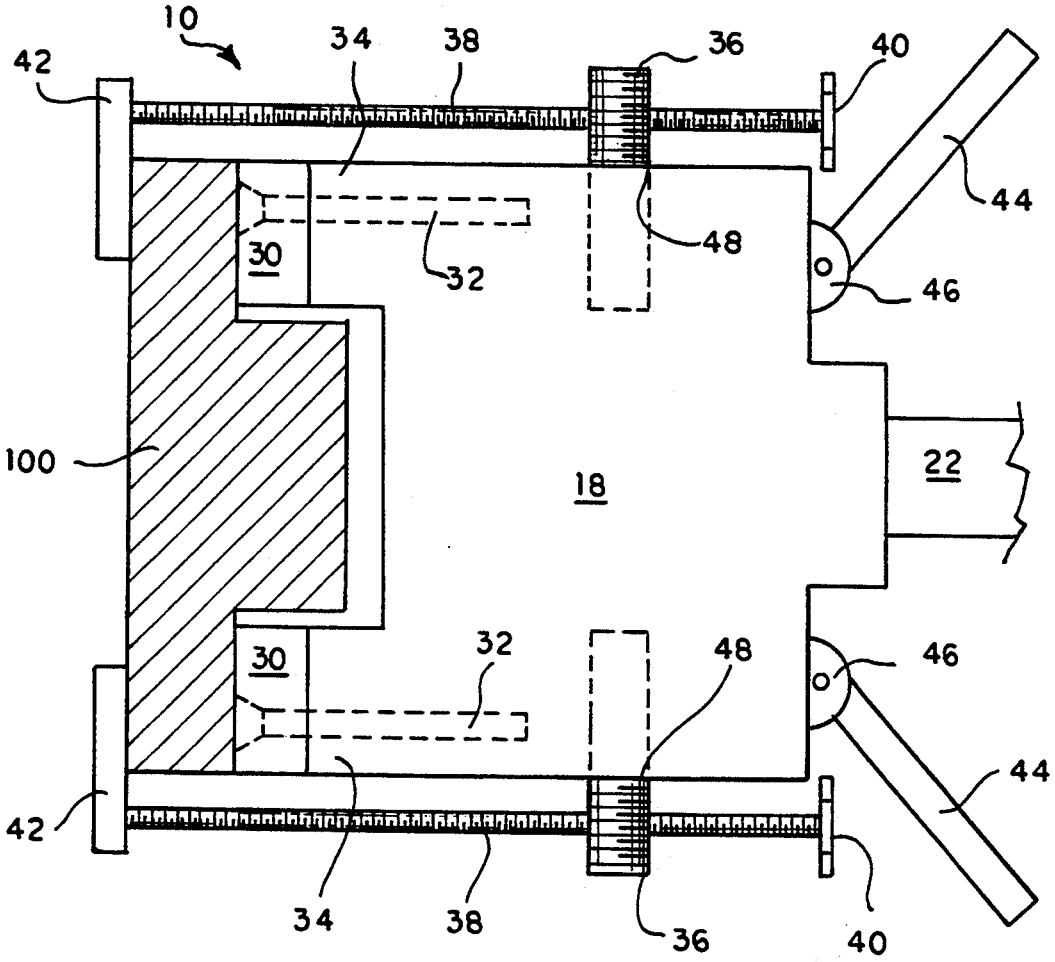
FIG. 2 is a partial view of the door buck spreader shown engaging a standard door buck.

Referring now to FIG. 2, we see a partial view of door buck spreader 10 engaging a standard door buck 100. In this figure, frame mount 18 engages door Duck 100 through spacers 30 attached to pillar-like extensions 34 of frame mount 18 by means of threaded members 32. The door buck spreader 10 is then secured to door buck 100 by means of the frame clamp assembly which comprises: lateral threaded adjustment members, 36; longitudinal threaded adjustment members, 38; manipulating means 40, for adjusting longitudinal members 38; and grip foot means 42 for engaging door buck 100. In addition, holder members 44 pivotally connected to frame mount 18, by means of pivotal joint assembly 46, allow adjustable longitudinal members 38 to be supported at the opposite end of frame mount 18 when not used in securing door frame 100. When door buck 100 is secured by frame mount 18, holder members 44 are pivoted out of the way such that longitudinal members 38 may be extended to securely hold a standard door buck 100. Threaded lateral adjustment members 3G engage the sidewall portions of frame mounts 18 through matingly threaded openings 48. Threaded longitudinal members 38 engage lateral adjustment members 36 through matingly threaded openings 50. Manipulating means 40, and grip feet 42 are attached rigidly and pivotally, respectively, to opposite ends of threaded longitudinal members 38 of the frame clamp assembly. A hex nut, welded to the end of adjustable longitudinal member 38, has proven to be most effective and practical as manipulating means 40.

Figure 5:
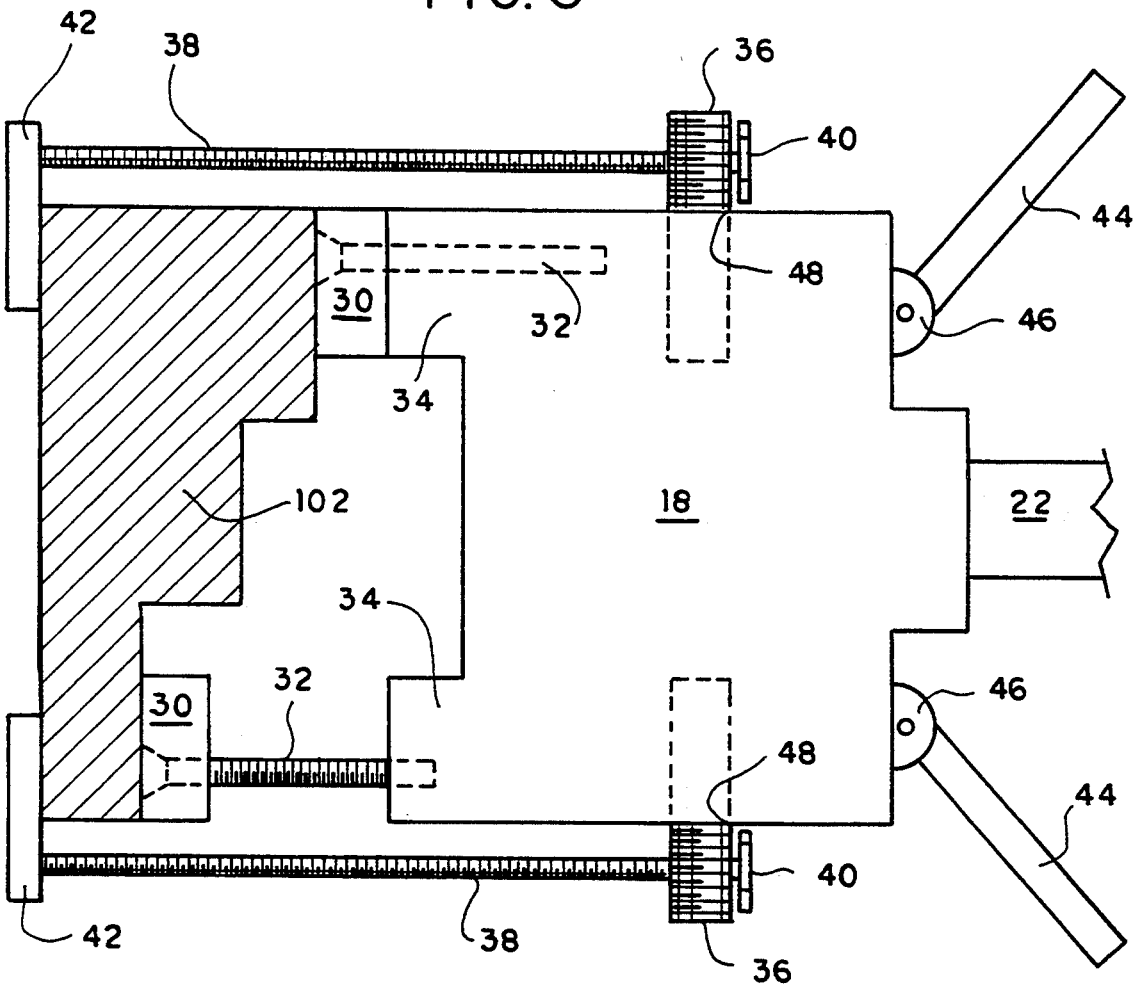
FIG. 5 is a partial view of the door buck spreader engaging an irregular shaped door buck, with spacers appropriately adjusted.
Figure 6:
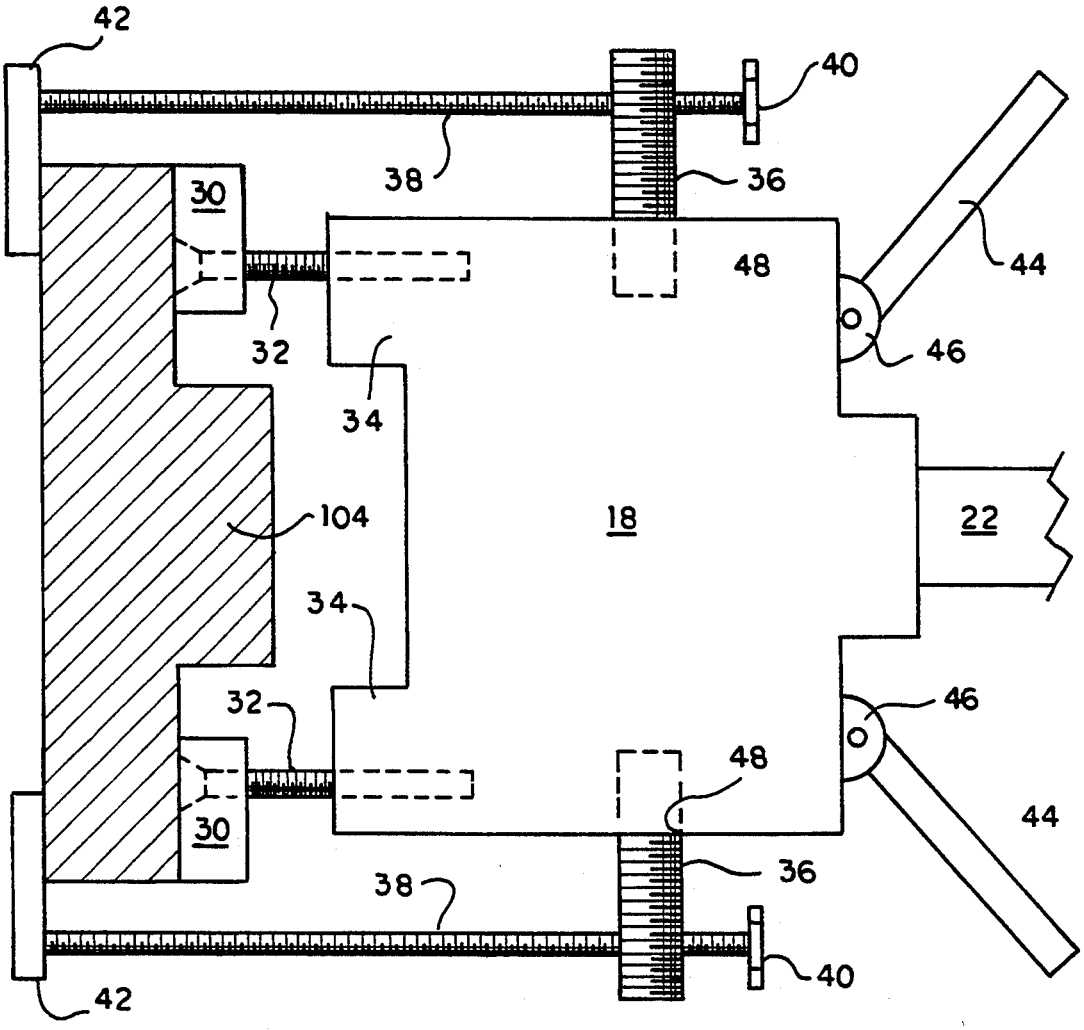
FIG. 6 is a partial view of the door buck spreader engaging a door buck having a frame wider than standard width, with spacers, pillars, and frame clamp assemblies appropriately adjusted.

FIG. 2 clearly illustrates how door buck spreader 10 may be used with a standard door buck, 100. FIGS. 5 and 6 show how the spacers and frame clamp assembly may be adjusted to allow door buck spreader 10 to be adapted to an irregular shaped door buck, 102, and an extra wide door buck, 104. Again, holder members 44 are pivoted out of the way such that longitudinal members 38 may be adjusted to hold irregularly-shaped door buck 102 or 104 securely. To accommodate different door bucks 100, 102, and 104, spacers 30 may be repositioned from their standard position against pillars 34 of frame mount 18 (see FIGS. 1, 2, and 8). This repositioning is accomplished through either rotating spacers 30 about threaded fasteners 32, ideally long screws, or through the backing out of threaded fasteners 32 from pillars 34, or both. This ill allow the present invention to be adjusted to fit door bucks having a variety of cross-sections. In addition, so that door buck, 100, 102, or, 104, may be secured to frame mount 18, the lateral 36 and longitudinal support members 38 need only be threaded into new positions that would accommodate the specific door buck involve.

Figure 7:
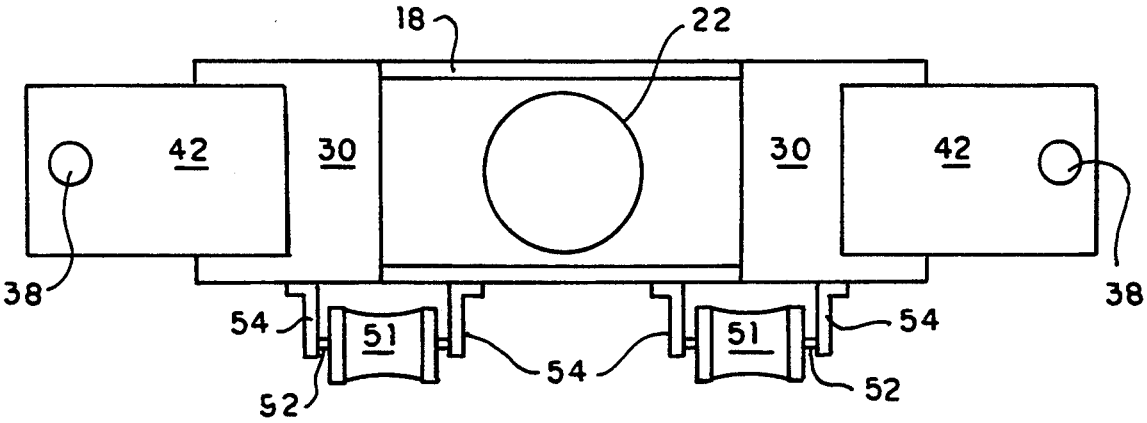
FIG. 7 is an end elevation view of one of the frame mounts of the door buck spreader showing the offset fasteners for the spacers as well as the wheels as seen on each frame mount.

FIG. 7 presents an end view of frame mount 18 of door buck spreader 10. A wheel assembly, typical to each frame mount 18, is clearly illustrated here. Four identical, L-shaped, bracket members 54 are mounted in pairs to the underside of frame mount 18. Axle members 52 rotatably engage brackets 54 through openings therein (not shown). Rigidly attached to axle members 52 are solid wheels 51 having a generally cylindrical shape, whereby the outer walls of the cylinders are not linear, but arcuately tapered towards the centerline of axles 52. This wheel assembly allows the door buck spreader 10 to be utilized in a manner not seen in the prior art, that is, a door buck spreader 10 capable of transporting the door buck, 100, 102, or 104, that it has been attached thereto.

Figure 8:
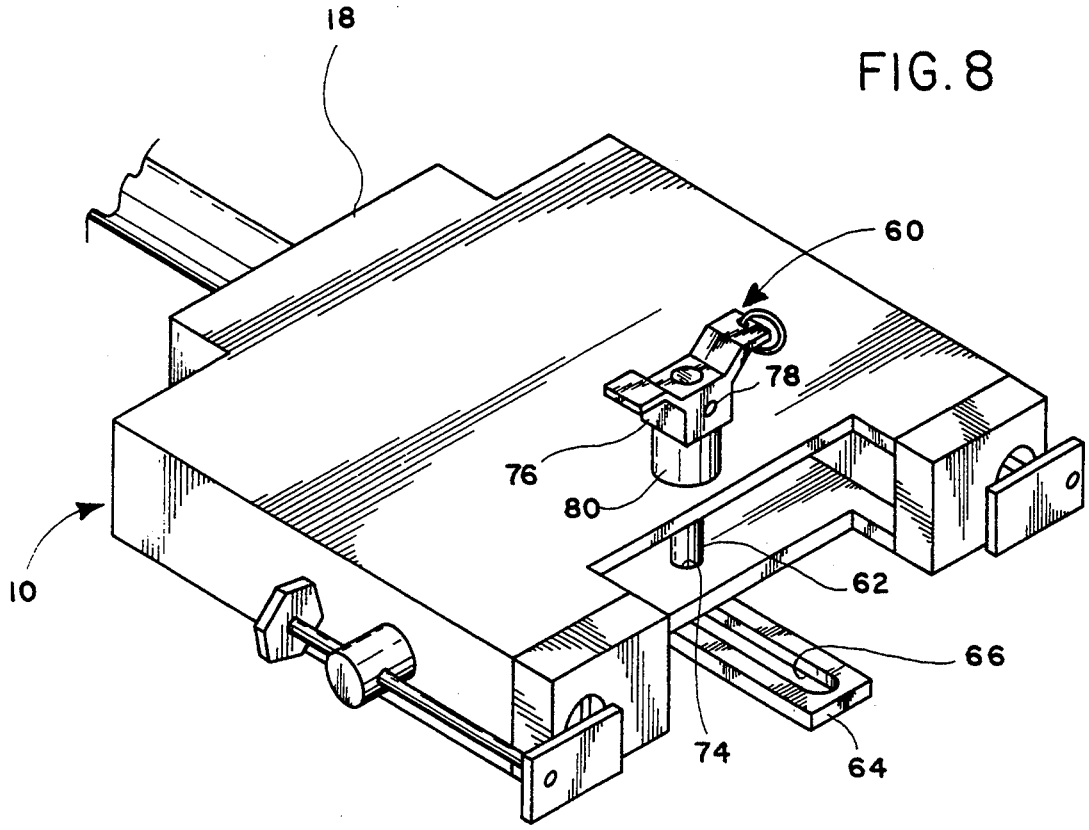
FIG. 8 is a top partial perspective view of the door buck spreader with the additional load support member incorporated into the frame mount extending forward therefrom.
Figure 9:
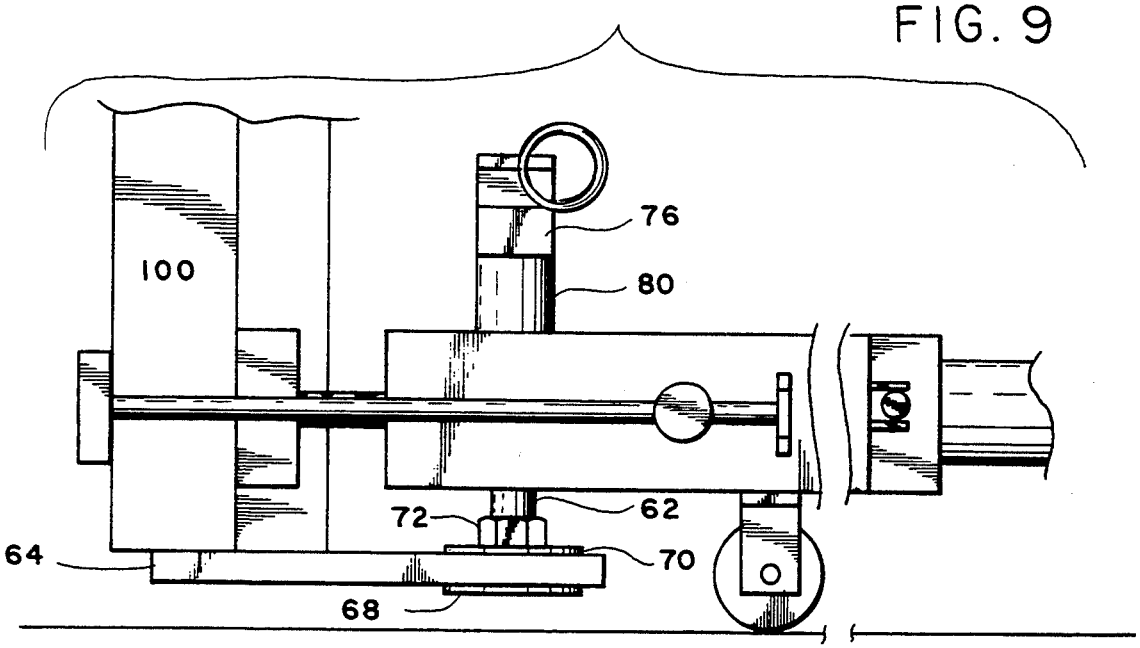
FIG. 9 is a partial side view of the door buck spreader engaging a door buck showing the frame mount engaging a standard door buck with the additional load support member in place as well as the frame clamp assemblies.

Referring now to FIGS. 8 and 9, a frame mount 18 of door buck spreader 10 is illustrated having additional load support assembly 60 incorporated into frame mount 18 for providing additional support to heavier door bucks and frames being transported by door buck spreader 10. Additional load support assembly 60 comprises a substantially smooth rod 62 having one end threaded and a number of passageways 61 (not visible) extending laterally through rod 62 at the opposite end of the threads. A rectangular shaped load bearing plate 64, having a longitudinally running slot 66, engages the threaded end of rod 62 and is supported by washer 68 welded normal to the threaded end of rod 62. Further securing load bearing plate 64 in a desired position are washer 70 and plate securing nut 72, which is matingly threaded to receive the threaded portion of rod 62. Rod 62 may then be inserted into openings 74 in the top and bottom of frame mount 18 along the longitudinal centerline thereof. Handle portion 76, secured to rod 62 by pin fasteners 78, extending through lateral openings 61, completes the basic load support assembly 60 within frame mount 18. A spacer 80, having an open cylindrical configuration, slidably engages substantially smooth rod 62 above frame mount 18 and beneath handle 76, further strengthening load support assembly 60. FIG. 9 depicts the assembly 60 in use along with the other components of door buck spreader 10 engaging a standard door buck 100.

It is to be understood that the present invention is not limited to the sole embodiment described above, but encompasses any and all embodiments within the scope of the following claims.

I claim:

1. An adjustable door buck spreader for use in assembling, transporting and installing door frames of varying dimensions comprising:

a spacer assembly including first and second elongated elements having inner ends and axially aligned with intermediate adjustment means, said first ad second elongated elements having outer ends each affixed to a first and second frame mount, respectively, said first and second frame mounts each including an outer face provided with two outside pillars bounding a central door stop cavity to define a profile mating with that of a conventional door frame having a central door stop section bounded by substantially symmetrical lateral sections.

spacer means carried by at least one said pillar and adjustably attached thereto to adapt said frame mount outer face to accommodate the profile of an offset door frame wherein a central door stop section is bounded by asymmetrical lateral sections, each said frame mount having a pair of side walls respectfully extending rearwardly of one said frame mount pillar, a frame clamp assembly connected relative each said side wall and including laterally adjustable means attaching said clamp assembly to each said frame mount side wall, and a longitudinally displaceable rod carried by said laterally adjustable means and having a grip foot at a forward end and manipulating means at an opposite end.

2. The adjustable door buck spreader according to claim 1, wherein said intermediate adjustment means is a threaded cylindrical member scored such that two sets of opposing threads, originating at opposite ends of said threaded cylindrical member, meet in the longitudinal center thereof.

3. The adjustable door buck spreader according to claim 2, wherein said threaded cylindrical member having oppositely scored threads thereon is adapted to receive a bolt, matingly threaded to the right hand scored portion of said threaded cylindrical member and secured thereto by means of a set screw.

4. The adjustable door buck spreader according to claim 1, wherein said spacer means is adjustably attached to said pillar by means of a threaded member that passes therethrough at a point laterally off-center along the horizontal center line of the face of the spacer contacting the door buck surface.

5. The adjustable door buck spreader according to claim 1, wherein frame clamp assembly means connected relative each said side wall comprise:

first and second threaded rods for attaching said clamp assembly to said frame mount sides through matingly threaded openings defined by said side walls of said frame mount;

first and second threaded bores within said first and second threaded members, respectively, for receiving said longitudinally displaceable rods having mating threading to threading of said first and second threaded bores; and, pivotal attachment means attaching said grip feet to said longitudinally displaceable rods.

6. The adjustable door buck spreader according to claim 1, wherein said frame mount further comprises a top surface and a bottom surface normal to said side walls and has means defining aligned openings within said top surface and said bottom surface.

7. The adjustable door buck spreader according to claim 6, wherein an additional load support assembly is integrally connected to said frame mount through said top opening and said bottom opening in said top and bottom surfaces, respectively, said additional load support comprising:

a substantially smooth rod with first and second ends, said first end having a number of passageways laterally extending through the smooth end of the rod, said second end having threading scored thereon;

a nut matingly threaded so as to engage said second, threaded end of said rod;

a first washer for placement between said nut and a load bearing plate having means defining a longitudinal running slot, said first washer, said nut, and said load bearing plate accepting said second, threaded end of said rod;

a second washer, rigidly attached to said second, threaded end of said rod member, for securing said load bearing place to said substantially smooth rod; and, a handle member having means defining a first opening for receiving said substantially smooth rod and means defining a second opening for accepting a pin member through one of said lateral passageways within said substantially smooth rod, said pin connecting said handle member and said substantially smooth rod.

8. An adjustable door buck spreader for use in assembling, transporting and installing door frames of varying dimensions comprising:

a spacer assembly including first and second elongated elements having inner ends and axially aligned with intermediate adjustment means, said first and second elongated elements having outer ends each affixed to a first and second frame mount, respectively, each said frame mount including an outer face provided with two outside pillars bounding a central door stop cavity to define a profile mating with that of a conventional door frame having a central door stop section bounded by substantially symmetrical lateral sections, spacer means carried by at least one said pillar and adjustably attached thereto to adapt said frame mount outer face to accommodate the profile of an offset door frame wherein a central door stop section is bounded by asymmetrical lateral sections, each said frame mount having a pair of side walls respectfully extending rearwardly of one said frame mount pillar, a frame clamp assembly connected relative each said side wall and including laterally adjustable means attaching said clamp assembly to said frame mount side wall, and a longitudinally displaceable rod carried by said laterally adjustable means and having a grip foot at a forward end and manipulating means at an opposite end, and a wheel assembly incorporated within each frame mount for providing means of transportation of a door buck by said spacer assembly.

9. The adjustable door buck spreader according to claim 8 wherein said intermediate adjustment means is a threaded cylindrical member scored such that two sets of opposing threads, originating at opposite ends of said threaded cylindrical member, meet in the longitudinal center thereof.

10. The adjustable door buck spreader according to claim 9, wherein said threaded cylindrical member having oppositely scored threads thereon is adapted To receive a bolt, matingly threaded to the right hand scored portion of said threaded cylindrical member and secured thereto by means of a set screw.

11. The adjustable door buck spreader according to claim 8, wherein said spacer means is adjustably attached to said pillar by means of a threaded member that passes therethrough at a point laterally off-center along file horizontal center line of the face of the spacer contacting the door buck surface.

12. The adjustable door buck spreader according to claim 8, wherein frame clamp assembly means connected relative each said side wall comprise:

first and second Threaded rods for attaching said clamp assembly to said frame mount sides through matingly threaded openings defined by said side walls of said frame mount;

first and second Threaded bores within said first and second threaded members, respectively, for receiving said longitudinally displaceable rods having mating threading to threading of said first and second threaded bores; and, pivotal attachment means attaching said grip feet to said longitudinally displaceable rods.

13. The adjustable door buck spreader according to claim 8, wherein said wheel assembly comprises two pair of brackets per frame mount, each pair of said brackets supporting an axle, which in turn, supports a wheel.

14. The adjustable door buck spreader according to claim 8, wherein an additional load support assembly is integrally connected to said frame mount through a top opening and a bottom opening in a top surface and a bottom surface, respectively, said additional load support comprising:

a substantially smooth rod with first and second ends, said first end having a number of passageways laterally extending through the smooth end of the rod, said second end having threading scored thereon;

a nut matingly threaded so as to engage said second, threaded end of said rod;

a first washer for placement between said nut and a load bearing plate having means defining a longitudinal running slot, said first washer, said nut, and said load bearing plate accepting said second, threaded end of said rod;

a second washer, rigidly attached to said second, threaded end of said rod member, for securing said load bearing plate to said substantially smooth rod; and, a handle member having means defining a first opening for receiving said substantially smooth rod and means defining a second opening for accepting a pin member through one of said lateral passageways within said substantially smooth rod, said pin connecting said handle member and said substantially smooth rod.

* * * * *